United States Patent [19]

Nelson

[11] Patent Number: 4,813,627

[45] Date of Patent: Mar. 21, 1989

[54] REWINDABLE HOSE REEL

[75] Inventor: Terry N. Nelson, Shoreview, Minn.

[73] Assignee: The Specialty Mfg. Co., St. Paul, Minn.

[21] Appl. No.: 87,898

[22] Filed: Jul. 31, 1987

[51] Int. Cl.[4] ..... B65H 75/48

[52] U.S. Cl. ..... 242/107.7; 242/107.4 R

[58] Field of Search ..... 242/107.6, 107.7, 107, 242/107.3, 107.4 R, 86, 86.1

[56] References Cited

U.S. PATENT DOCUMENTS

| | | | |
|---|---|---|---|
| 2,530,773 | 11/1950 | Johnson et al. | 242/107.7 X |
| 2,629,630 | 2/1953 | Roark | 242/107.6 X |
| 2,907,534 | 10/1959 | Benstein | 242/86 |
| 2,976,959 | 3/1961 | Husted | 242/107.6 X |
| 3,085,768 | 4/1963 | Treutelaar | 242/107 |
| 3,450,369 | 6/1969 | Blanch et al. | 242/107.7 |
| 3,486,712 | 12/1969 | Hoday | 242/107.7 |
| 3,625,450 | 12/1971 | Lloyd, Jr. | 242/86 |
| 3,715,526 | 2/1973 | Blanch et al. | 242/107.6 X |

*Primary Examiner*—John M. Jillions

*Attorney, Agent, or Firm*—Dorsey & Whitney

[57] ABSTRACT

An automatic rewindable garden hose reel is provided that eliminates the need for an external power source. A flat spring is reversely biased as the hose reel is unwound, storing energy for hose retraction. The retraction is selectively activated by a ratchet mechanism. A hose guiding fairlead guides the hose onto and off of the hose reel.

17 Claims, 2 Drawing Sheets

REWINDABLE HOSE REEL

TECHNICAL FIELD

This invention pertains to lawn care devices. In particular, it pertains to a garden hose reel assembly with a spring powered, automatic rewind mechanism.

BACKGROUND ART

Windable reels for compactly storing flexible garden hose are well known. Rewind of garden hose reels is normally accomplished by manually turning the reel. Alternatively, a motor can be used to rewind a hose onto a supporting reel as is disclosed in U.S. Pat. No. 3,217,738. Manual winding is both tiresome and inconvenient. Motorized winding, although not tiresome, is expensive, requires a power source, and adds weight to the reel assembly. A mechanically powered, inexpensive, and lightweight automatic rewind mechanism for rewinding a garden hose would be a decided advantage.

SUMMARY OF THE INVENTION

A lightweight hose reel assembly is disclosed herein that includes a mechanically actuated, automatic rewind mechanism. The hose reel assembly hereof broadly includes a hose reel, rewind mechanism, hose guiding fairlead, and a wall mount for supporting the reel, rewind mechanism and fairlead.

The rewind mechanism comprises a flat spring wound about a supporting spool, a ratchet mechanism and a spring braking surface. The spring is shifted from the supporting spool to a take up, tensioning spool as the hose is unwound from the reel. The braking surface abuts against the spring as it is wound on the tensioning spool.

The particular construction of the hose reel assembly, in accordance with the present invention, provides several advantages. The rewind mechanism is energized by the operator's action of unwinding the hose and thereby eliminates the need for other energy input. The particular spring configuration disclosed releases stored energy at a relatively constant rate thereby eliminating excessive rotation speed. The fairlead evenly distributes the hose across the hose reel drum and prevents hose entanglements. The ratchet mechanism alternatively enables and prevents hose rewind rotation. The braking surface limits the number of hose reel rotations in the hose payout direction.

DETAIL DESCRIPTION OF THE DRAWINGS

Figure 1:
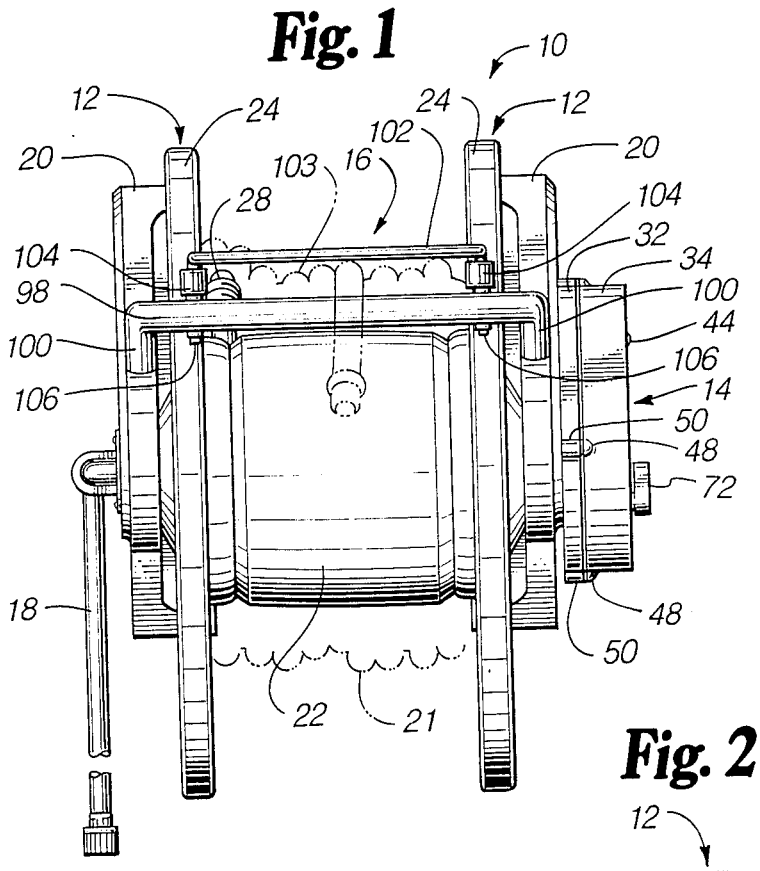
FIG. 1 is a front elevational view of a garden hose reel in accordance with the present invention.

Referring to the drawings, a hose reel assembly 10, in accordance with the present invention, broadly includes a hose reel 12, a rewind mechanism 14, a fairlead assembly 16 and a connecting hose 18, all supported by wall mount 20. A hose 21 is wound about and supported by the hose reel 12.

The hose reel 12 includes an axially mounted hose support drum 22, reel sides 24, reel axle 26, hose reel outlet tube 28, and a watertight rotary connector (not shown) joining the connecting hose 18 to the hose reel outlet tube 28 in a fluid communicating relationship. The hose reel 12 is rotatably supported by wall mount 20. In particular, the reel axle 26 is rotatably supported by wall mount reel support flanges 30.

Figure 3:
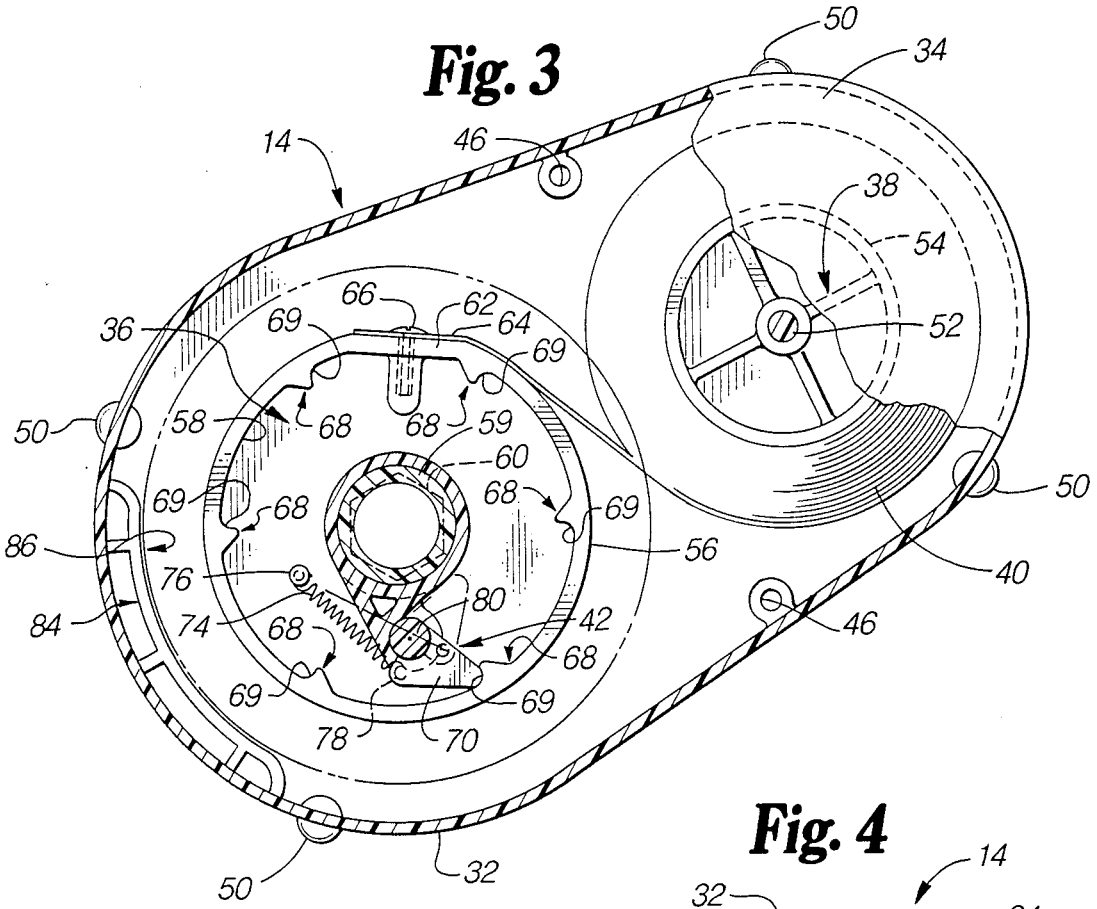
FIG. 3 is a fragmentary, side sectional view of the rewind mechanism.
Figure 4:
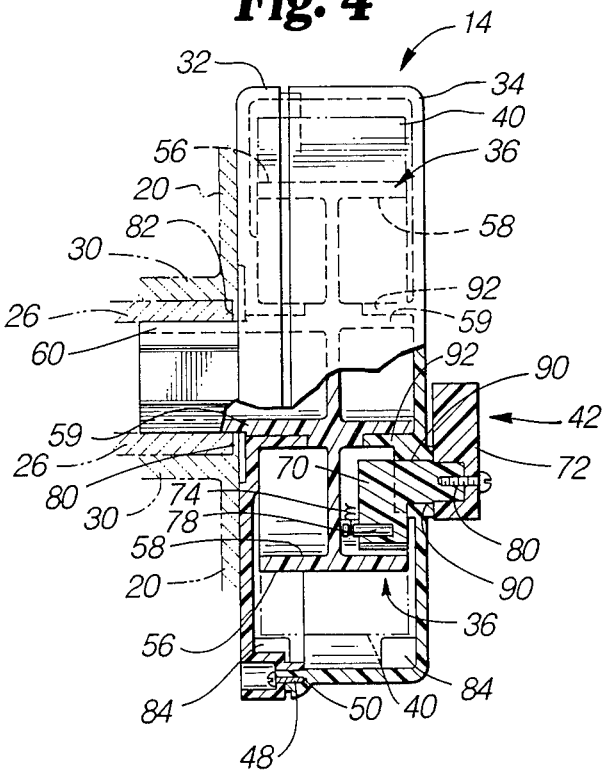
FIG. 4 is a fragmentary, front sectional view of the rewind mechanism.

Referring to FIGS. 3 and 4, the rewind mechanism 14 broadly includes a rewind mechanism base 32, rewind mechanism cover 34, spring tensioning spool 36, spring return spool 38, flat spring 40 and ratchet pawl assembly 42.

Attaching screws 44 mount the rewind mechanism unit 14 to the wall mount 20 through attaching screw receiving holes 46. Drive pins 48 received through the rewind mechanism base 32 are received within holes 50 defined by the rewind mechanism cover 34.

The spring return spool 38 includes a spring return spool axle 52, and a spring return spool support surface 54. The spring return spool 38 is rotatably attached to the rewind mechanism base 32 and the rewind mechanism cover 34 by the spring return spool axle 52. The flat spring 40 is carried by the spring return support surface 54.

The spring tensioning spool 36 comprises an outer spring support wall having an outer wall surface 56 and an inner wall surface 58, a spring tensioning spool axle 59 and a hex actuator shaft 60. The outer spring support wall surface 56 is generally arcuate, but forms a flat attachment area 62. The flat spring 40 mounts to the flat attachment area 62 at the flat spring attachment end 64 with flat spring attachment drive pin 66. The inner spring support wall surface 58 forms a series of ratchet teeth 68 each having a ratchet pawl capturing side 69 and a ratchet pawl slipping side 71. The hex actuator shaft 60 attaches to the reel axle 26 through the rewind mechanism base 32.

The ratchet pawl assembly 42 comprises a ratchet pawl 70, a ratchet pawl lever 72, a ratchet tension spring 74, a ratchet tension spring drive pin 76, a ratchet tension spring ratchet pawl drive pin 78 and a ratchet pawl shaft 80. The ratchet pawl assembly 42 is located inside the spring tensioning spool 36 circumference. The ratchet pawl 70, positioned inside the rewind mechanism cover 34, and the ratchet pawl lever 72, positioned outside the rewind mechanism cover 34, rotatably attach the ratchet pawl shaft 80 to the rewind mechanism cover 34. The ratchet tension spring 74 extends between drive pin 76 and pin 78 positioned on the ratchet pawl 70. As depicted in FIG. 3, the pawl shaft 80 provides a pawl pivot axis for pawl 70. Ratchet tension spring 74 shifts over center of the pawl pivot axis as the pawl 70 shifts between the ratchet engaging position depicted in solid lines in FIG. 3, and the ratchet clearing position depicted in phantom lines in FIG. 3.

The rewind mechanism base 32 includes a support collar (not shown) for rotatably supporting the first end of the axle 52 of the spring return spool 38, a hex actuator shaft opening 82 and a braking surface 84. The braking surface 84 comprises a circular arc 86 at a predetermined distance from the spring tensioning spool outer spring support wall 56. The rewind mechanism cover 34 includes a support collar (not shown) for rotatably supporting the second end of axle 52 of the spring return spool 38, a ratchet pawl shaft opening 90, a spring tensioning spool axle receiving hole 92 and a braking surface 84 comprising a circular arc 86 at a predetermined distance from the spring tensioning spool outer spring support wall 56.

The fairlead assembly 16 includes a fairlead hose support bar 98, bar supports 100, fairlead rail 102 and attaching rollers 104. The bar supports 100 are fixedly attached to the wall mount 20. The fairlead hose support bar 98 runs between the bar supports 100. The fairlead rail 102 is positioned slightly above the fairlead hose support bar 98 forming a slot 103. The fairlead rollers 104 form opposite sides of the slot 103. Attaching nuts 106 mount the fairlead rail 102 and fairlead rollers 104 to the fairlead hose support bar 98. Annular hose stop 108 is carried by the terminal end of garden hose 21. The outer diameter of the hose stop 108 is wider than the narrowest width of the slot 103.

Figure 2:
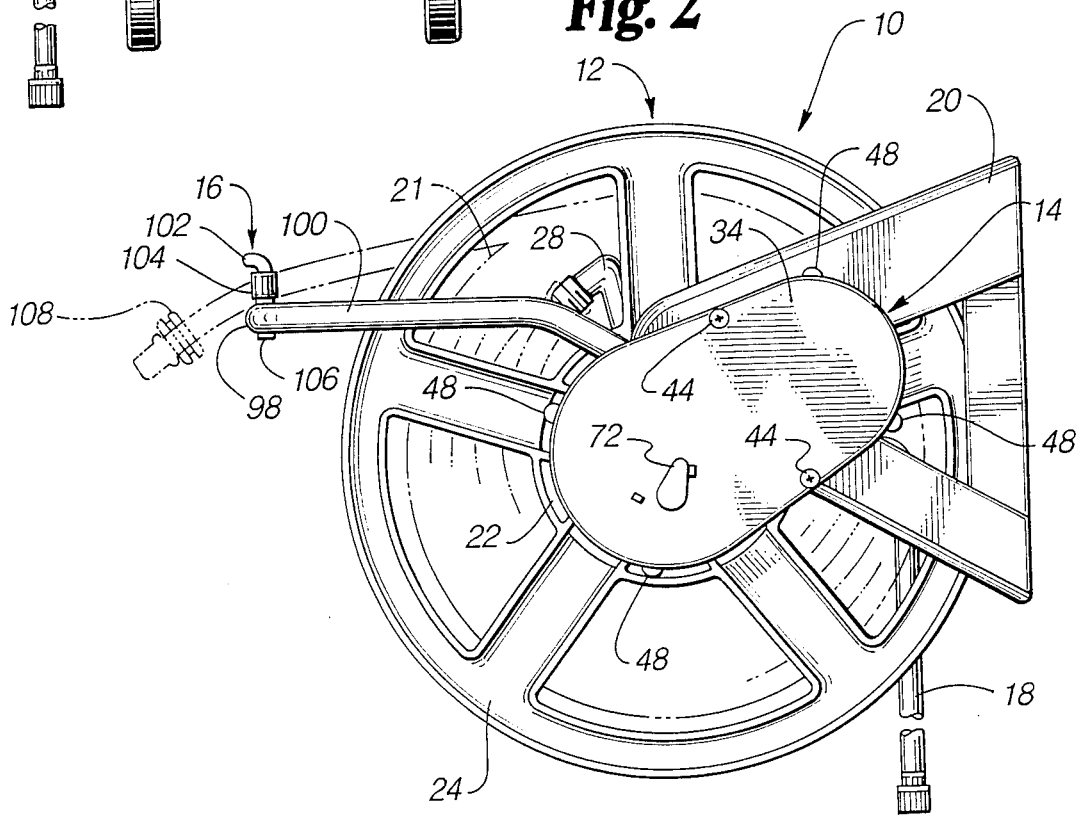
FIG. 2 is a side elevational view of the apparatus depicted in FIG. 1.

In operation, the hose reel 12, the rewind mechanism 14 and the fairlead assembly 16 comprise a garden hose retraction system. As depicted in FIGS. 1 and 2, the hose 21 is coiled on the hose reel 12 with the outer end of the hose 21 placed between the fairlead hose support bar 98 and the fairlead rail 102. The rewind mechanism 14 is attached to the wall mount 20.

Referring to FIGS. 3 and 4, the flat spring 40 will be coiled about the spring tensioning spool 36 into a spring winding in a coiling direction opposite the bias of the flat spring 40 as the hose reel 12 is rotated in a hose payout direction. As the flat spring 40 is coiled about the spring tensioning spool 36, the diameter of the spring winding coiled about the spring tensioning spool 36 increases until the spring winding diameter abuts against the braking surface 84, thereby halting hose reel 12 rotation in the hose payout direction. The reversely biased flat spring 40 coiled about the spring tensioning spool 36 urges the hose reel 12 to rotate in the hose take up direction. The flat spring 40 uncoils from the spring tensioning spool 36 and is received by the spring return spool 38 when the hose reel 12 is allowed to rotate in the hose take up direction.

The ratchet pawl 70 is shiftable between ratchet tooth engaging position and ratchet tooth clearing positions. In the engaging position, the ratchet pawl 70 abuts the ratchet pawl capturing side 69 of one of the ratchet teeth 68 when the hose reel 12 is urged in the hose take up direction. The ratchet pawl 70, when in the engaging position, is pushed clear of the ratchet teeth 68 by the ratchet pawl slipping side 71 of ratchet teeth 68 as the hose reel 12 is rotated in the hose payout direction. In the clearing position, the ratchet pawl 70 clears the ratchet teeth 68 and the hose reel 12 may rotate freely in either the hose take up direction or the hose payout direction. The ratchet pawl tension spring 74 maintains the ratchet pawl 70 in the selected engaging or clearing position, as the ratchet tension spring 74 shifts over center of the pawl pivot axis presented by pawl shaft 80. The ratchet pawl 70 is shifted between the ratchet engaging position and the ratchet clearing position by manipulation of the ratchet pawl lever 72.

The fairlead hose support bar 98, fairlead rail 102 and fairlead rollers 104 guide the hose both onto and off of the hose support drum 22 by keeping the hose free from the sides of the hose reel 12 and by fixing the point at which the hose reel is received by the hose support drum 22. The annular hose stop 103 abuts against the fairlead assembly 16 once the hose 21 is completely rewound on hose reel 12 to prevent further rotation of the rewind mechanism spools 36 and 38.

I claim:

1. A rewind mechanism for a retractable hose reel assembly having a reel support frame and a hose reel for supporting a hose or the like, said hose reel rotatably supported by said support frame for rotation in a first, hose pay out direction and a second, opposed, hose take up direction, comprising:

a spring tensioning spool operably coupled to said reel for rotation therewith;

a spring return spool operably coupled to said frame;

a flat spring coilably received by said return spool and including an outermost, attachment end portion;

means for fixedly attaching said spring attachment end portion to said spring tensioning spool for rotation therewith whereby said spring is wound about said spring tensioning spool when said hose reel is rotated in said first direction, thereby tensioning said spring for urging said hose reel to rotate in said second direction, said spring presenting a coiled winding having a peripheral coiled winding diameter about said spring tensioning spool as said spring is wound about said tensioning spool; and a braking surface for abutting against said coiled winding when said peripheral coiled winding diameter reaches a predetermined maximum value, thereby limiting the number of rotations of said hose reel in said first direction to a preselected maximum.

2. The invention as claimed in claim 1, including locking means operably coupled to said hose reel for selectively locking said hose reel from rotating in said second direction.

3. The invention as claimed in claim 2, said locking means being shiftable between a first position wherein said hose reel rotates only in said first direction, and a second position wherein said hose reel rotates in either said first direction or said second direction.

4. The invention as claimed in claim 3, said spring tensioning spool including a generally tubular spring support wall having an outer, generally annular spring support surface and an opposed inner surface, said locking means comprising a ratchet notch defined by said support wall inner surface and a ratchet pawl operably coupled to said frame for selectively engaging said ratchet notch when said locking means are in said first position, said ratchet pawl clearing said ratchet notch when said locking means are in said second position.

5. The invention as claimed in claim 3 or 4, including a maintaining means for alternately maintaining said locking means in said first position or said second position.

6. The invention as claimed in claim 4, said locking means including a biasing means for holding said ratchet pawl in said first position or said second position.

7. The invention as claimed in claim 6, said ratchet pawl operably pivotally mounted to said frame for rotation about a pivot point.

8. The invention as claimed in claim 7, said biasing means including a first attachment end portion operably coupled to said frame and a second, opposed attachment end portion operably coupled to said ratchet pawl, said second attachment end portion being pulled over said ratchet pawl pivot point as said ratchet pawl is moved between said first position and said second position, said biasing means thereby alternately maintaining said ratchet pawl in either said first or said second position.

9. The invention as claimed in claim 8, said biasing means being a spring.

10. The invention as claimed in claim 4, including a maintaining means for alternately maintaining said locking means in said first position or said second position, said maintaining means comprising a biasing means for alternately urging said locking means into said first position or said second position.

11. The invention as claimed in claim 10, said ratchet pawl operably coupled to said frame, said biasing means comprising a biasing spring having a first biasing spring end operably coupled to said ratchet pawl, and a second biasing spring end operably coupled to said frame.

12. The invention as claimed in claim 1, said spring tensioning spool including a spring attachment surface generally conforming to said spring attachment end portion.

13. The invention as claimed in claim 12, said spring tensioning spool including a generally tubular spring support wall for coilably receiving said flat spring, said spring attachment end portion comprising a generally planar surface, said generally tubular spring support wall including a generally planar portion generally conforming to said spring attachment end portion forming said spring attachment surface.

14. The invention as claimed in claim 1, including guiding means fixedly attached to said reel support frame for guiding said hose off of said hose reel when said hose reel is rotated in said first direction and guiding said hose on to said hose reel when said hose reel is rotated in said second direction.

15. The invention as claimed in claim 14, said guiding means including structure defining an elongated slot adapted for receiving said hose therethrough, said hose reel being rotatable about a reel axis, and said slot oriented generally parallel to and spaced apart from said hose reel axis.

16. The invention as claimed in claim 15, said hose reel presenting an axial reel width, said structure defining said slot comprising opposed, spaced apart elongated hose support members extending substantially across said reel axial width, and opposed hose retaining members operably coupled to and generally extending between said hose support members.

17. The invention as claimed in claim 16, said hose retaining members comprising rotatable rollers.

* * * * *